US005259085A

United States Patent [19]

Marafante et al.

[11] Patent Number: 5,259,085

[45] Date of Patent: Nov. 9, 1993

[54] FLOOR-CARE WORK DISKS WHICH CAN BE ATTACHED BY CLIP MOUNTING TO THE DRIVE PLATE OF A FLOOR-CARE INSTRUMENT

[75] Inventors: Gentile Marafante, Carnate; Mario Tecchiati, Raverio, both of Italy; Wieland Gühne, Remscheid; Hans J. Birr, Wuppertal, both of Fed. Rep. of Germany

[73] Assignee: Vorwerk & Co. Interholding GmbH, Wuppertal, Fed. Rep. of Germany

[21] Appl. No.: 781,798

[22] Filed: Oct. 23, 1991

[30] Foreign Application Priority Data

Nov. 29, 1990 [DE] Fed. Rep. of Germany ... 9016249[U]

[51] Int. Cl.[5] ..... A47L 11/14

[52] U.S. Cl. ..... 15/98; 15/49.1; 15/87; 15/230; 51/177; 403/20; 403/408.1

[58] Field of Search ..... 15/50.1, 49.1, 87, 385, 15/98, 230, 230.17; 51/177; 403/20, 408.1

[56] References Cited

U.S. PATENT DOCUMENTS

| | | | |
|---|---|---|---|
| 1,870,232 | 8/1932 | Brim | 15/49.1 |
| 3,344,455 | 10/1967 | Pauler et al. | 15/50.1 |
| 3,401,416 | 9/1968 | Ziegler | 15/49.1 |
| 3,562,843 | 2/1971 | Belicka et al. | 15/49.1 |
| 3,908,220 | 9/1975 | Adamson et al. | 15/50.1 |

FOREIGN PATENT DOCUMENTS

| | | |
|---|---|---|
| 1705039 | 11/1955 | Fed. Rep. of Germany . |
| 1902667 | 10/1964 | Fed. Rep. of Germany . |
| 1982547 | 4/1968 | Fed. Rep. of Germany . |
| 1284069 | 11/1968 | Fed. Rep. of Germany . |
| 1454295 | 8/1966 | France . |

*Primary Examiner*—Edward L. Roberts
*Attorney, Agent, or Firm*—Martin A. Farber

[57] ABSTRACT

A floor-care work disk (4) which can be mounted by a clip mounting to the drive plate (1) of a floor-care apparatus (G) and has clip-tongue passage windows (6) and a resting surface (9) which permits wobbling movement between drive plate (1) and floor-care work disk. The resting surface (9) is arranged on the outside of the clip-tongue passage windows (6).

12 Claims, 7 Drawing Sheets

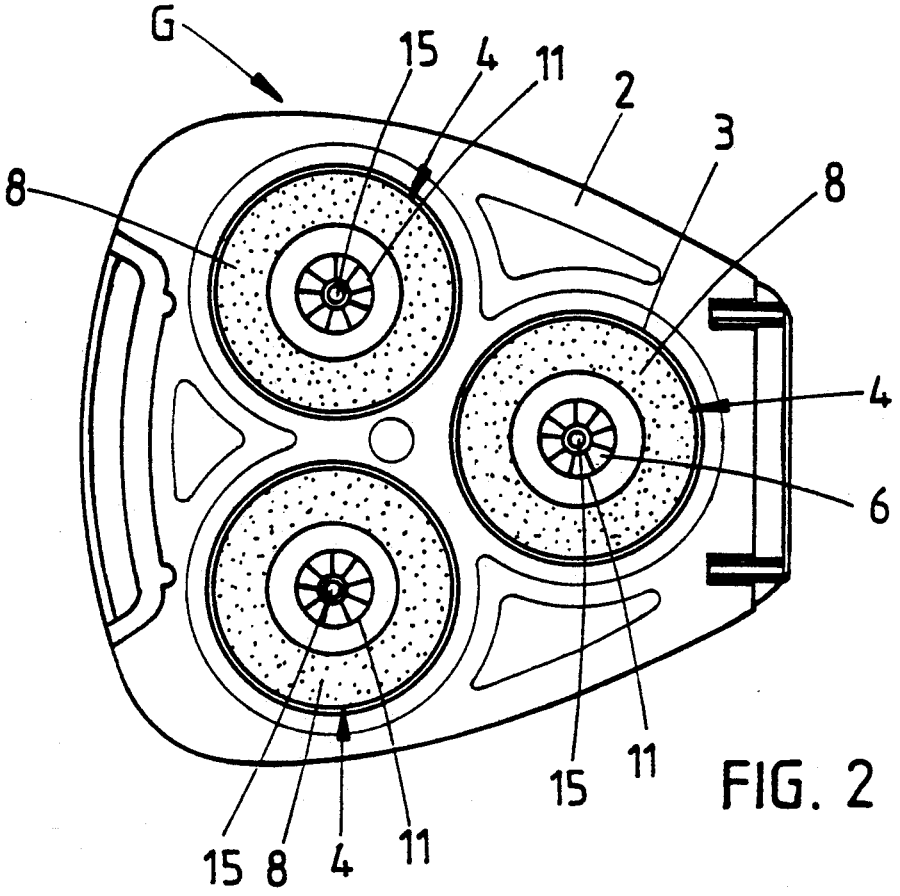
FIG. 2
FIG. 1
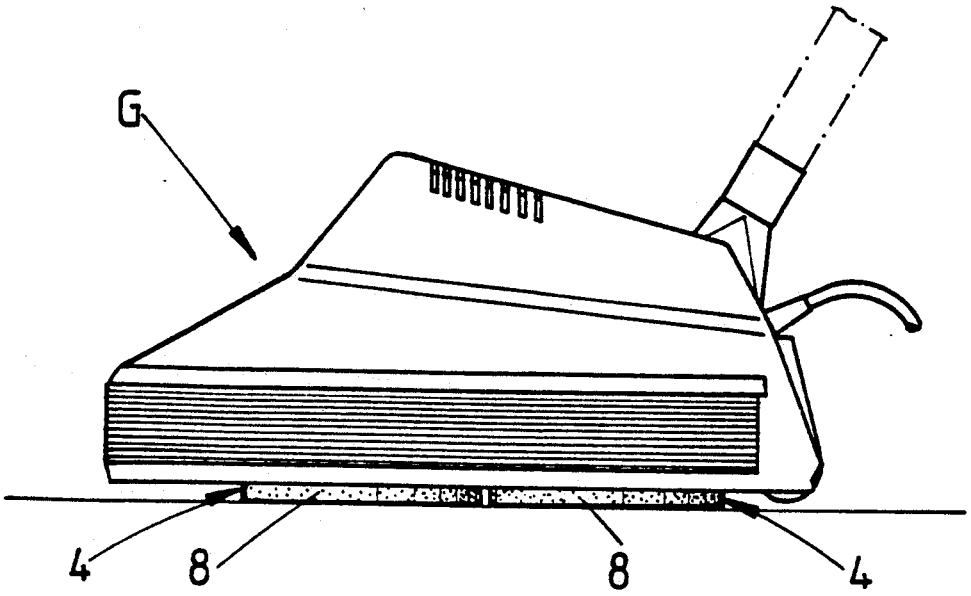

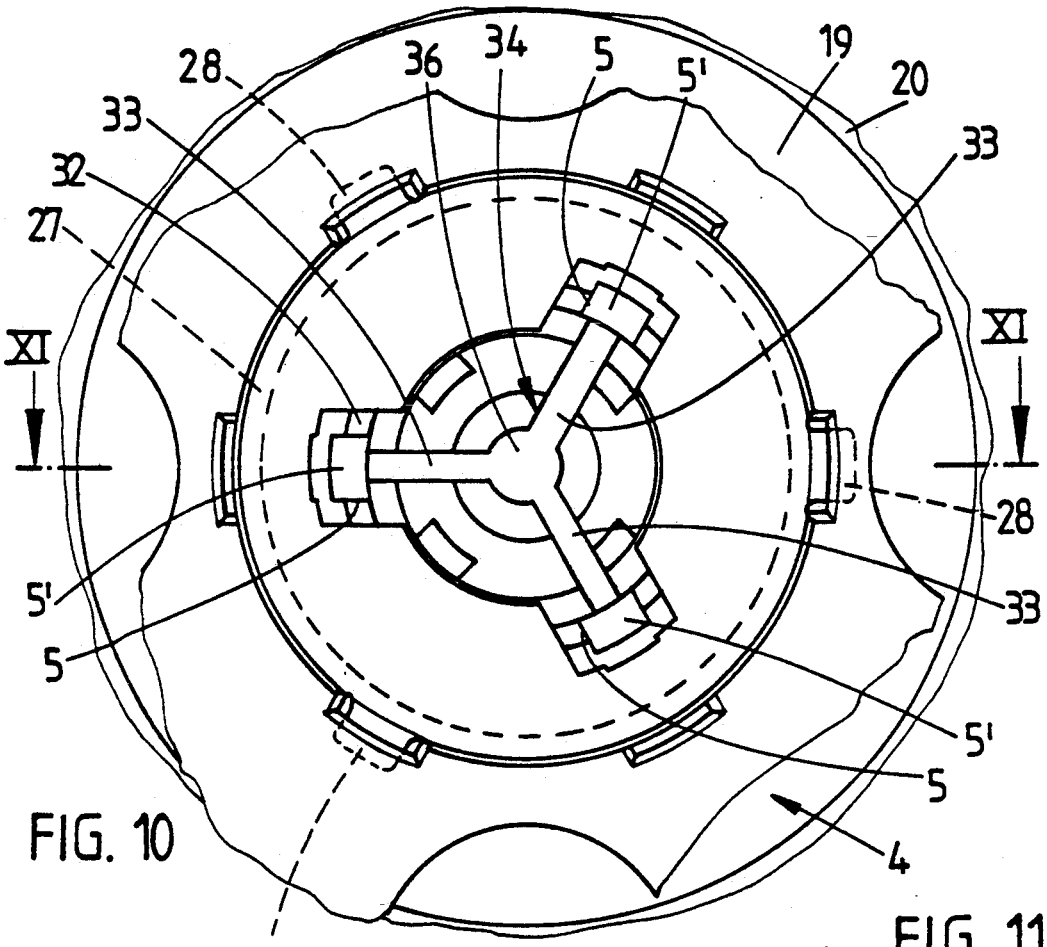
FIG. 10
FIG. 11
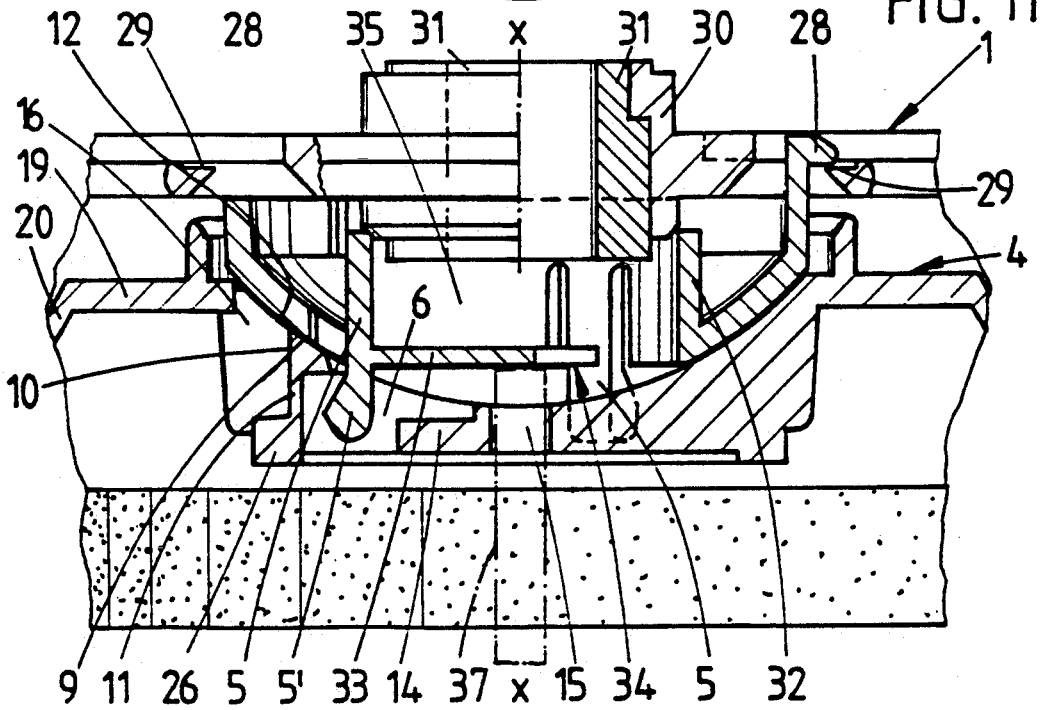

FLOOR-CARE WORK DISKS WHICH CAN BE ATTACHED BY CLIP MOUNTING TO THE DRIVE PLATE OF A FLOOR-CARE INSTRUMENT

FIELD AND BACKGROUND OF THE INVENTION

The present invention relates to a floor-care work disk which can be brought with clipping connection to the drive plate of a floor-care instrument having clip-tongue passage openings and a resting surface adjacent thereto which permits a wobbling movement between the drive plate and floor-care work disk.

The wobbling movement, which can also be referred to as limited freedom of tilting, provides the individual adjustment of the floor-care work disk or disks to the irregularities, never entirely to be excluded, of the floor to be worked, for instance, the wooden floor. In the known attachments the floor-care work disk has its drive-plate side wobble resting surface at its center, while in the vicinity of the periphery of the work disk there are furthermore provided support projections which, upon extreme positions of tilt, act in tilt-limiting manner for the work disk against the downward facing plate bottom of the drive setter. As a general rule, however, the wobble support load is, as stated, at the center.

SUMMARY OF THE INVENTION

It is an object of the present invention is to create a clip attachment which is more favorable from the standpoint of attachment and which leads to a wobble support which exerts less stress on the clip means and furthermore leaves the center free for some other measure which is advantageous from the standpoint of use.

As a result of the development of the invention, a work-disk arrangement is created which is both more favorable from a standpoint of support and more stable in use. The structural means are simple and suitable. The entire unit is based on the teaching that the resting surface is located on the outside of the passage windows for the clip tongues. In this connection the clip means are closer to the center, which is equivalent to substantial relief of them from load; on the other hand, the wobble support on the plate side, with due consideration of the play for the wobbling movement, is located outside the clipping zone and is therefore substantially more favorable from the standpoint of leverage. It is furthermore advantageous that the resting surface, which is now located rather far outward, now annularly surrounds the clip-tongue passage windows. By the outward displacement of the resting surface more surface also remains for the passage windows. Despite their inner position a large number of them can be provided. Therefore, no particular alignment of the work disk with respect to the work plate is required. The clip positions are simplified. There is furthermore the advantage that the annular surface is developed in cap shape. For cooperation in operation with this cap-shaped annular surface, the drive plate has the corresponding positive mating contour. The cap shape of the annular surface is accordingly concave. Furthermore, it is advantageous from the standpoint of attachment that the rear of the resting surface forms the mating surface for the clip tongues. The latter can also be moved back somewhat with respect to this rear side so that the clip tongues would grip over a sort of step edge. The passage windows are advantageously formed by radially directed spokes of a ring which, lying centrally in an opening in the floor-care work disk, is connected with it. In this way there is produced amply gridded, basket-like and thus material-saving structure which is, nevertheless, highly stable due to the polydirectional courses of the elements forming it. Furthermore, with a floor-care apparatus with drive plate for holding a floor-care work disk by clips, a development is obtained which is advantageous with respect to the attachment of the clips and which is even of independent importance due to a centrally bendable spider as connection of the clip tongues. Such a spider leads to a relatively high, almost taut clip mounting. The tightly clipping over-engagement is due namely, on the one hand, to the restoring force of the clip tongues themselves while, on the other hand, it is increased by the rearward resting spider tines. In the clipping process the central bending of the intermediate spider takes place, which, passing over the clip places, is immediately restored into the initial position. In this connection, there is also advantageous a solution in which the clip tongues extend from a cap-shaped body having the shape of a spherical segment and connected at its base to the drive plate, if said means are not formed on the drive plate itself. Finally, it is also advantageous for the floor-care work disk to be provided, centrally to the annular support surface, with a hole below the center of the spider. This hole favorably forms access for an auxiliary tool which may be necessary in order to actuate the centrally bendable spider so as in this way to effect a desired or necessary elimination of the clip attachment. This, accordingly, constitutes a further advantage of the supporting of the wobble movement shifted out of the center and furthermore provides a means for the unmistakable individualizing of the

BRIEF DESCRIPTION OF THE DRAWINGS

With the above and other objects and advantages in view, the present invention will become more clearly understood in connection with the detailed description of a preferred embodiment, when considered with the accompanying drawings, of which:

FIG. 1 is a side view of the floor-care apparatus equipped in accordance with the invention;

FIG. 2 is a bottom view thereof;

FIG. 10 is a bottom view of the drive plate with the work disk not yet attached, shown on a larger scale;

FIG. 11 is a section along the line XI—XI of FIG. 10; and

DETAILED DESCRIPTION OF THE PREFERRED EMBODIMENT

Figure 3:
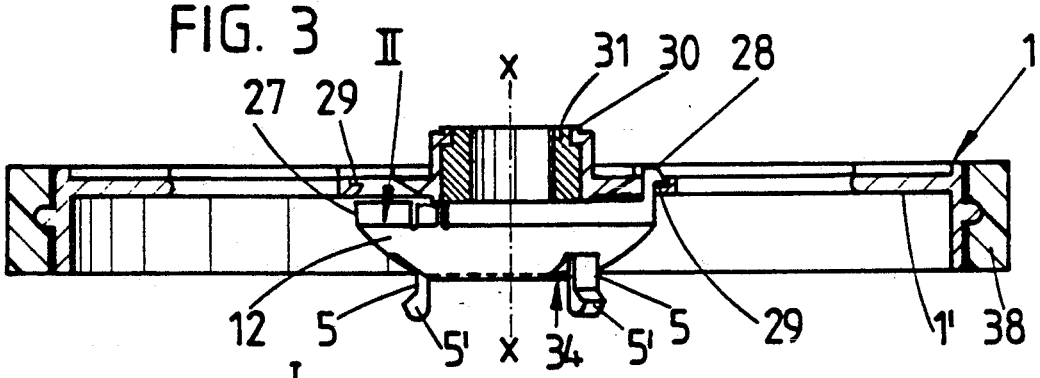
FIG. 3 shows one of the identical drive plates of the floor-care apparatus in a partial cross section, the cap which has the shape of a spherical segment not being itself shown in cross section.
Figure 4:
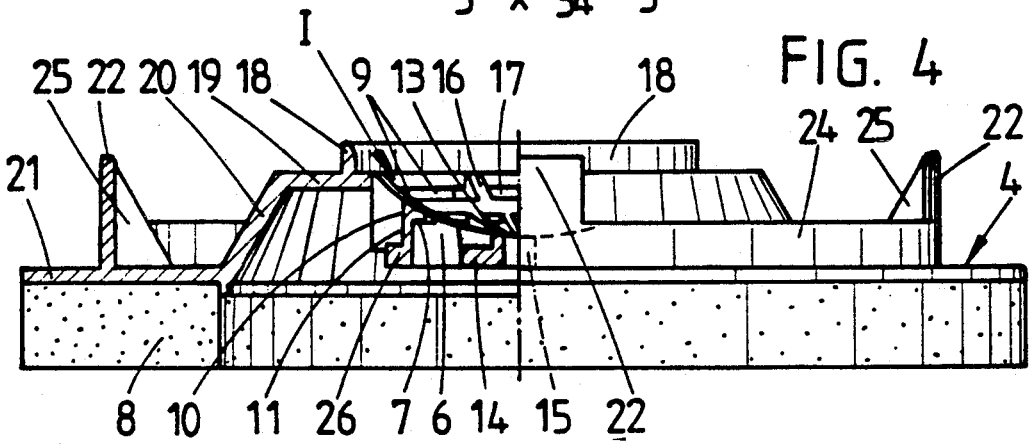
FIG. 4 shows the work disk in line ready for mounting, in a half section.
Figure 5:
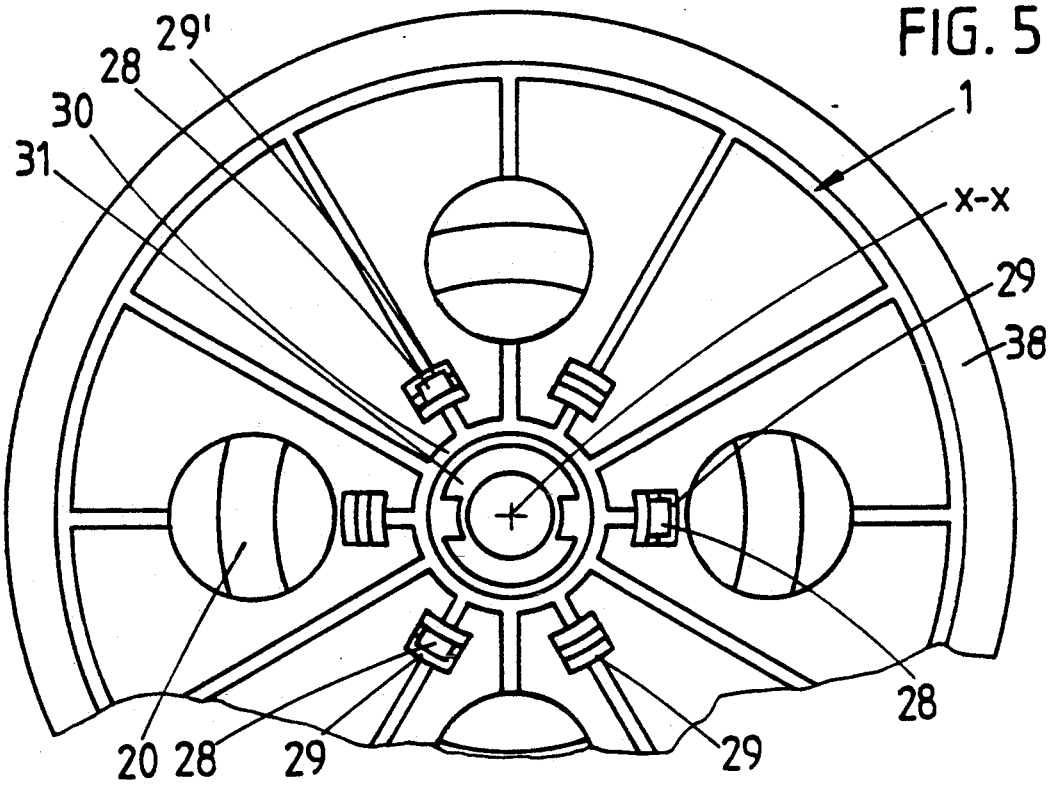
FIG. 5 is a top view of the drive plate, i.e. seen from the inside of the apparatus with work disk attached.
Figure 6:
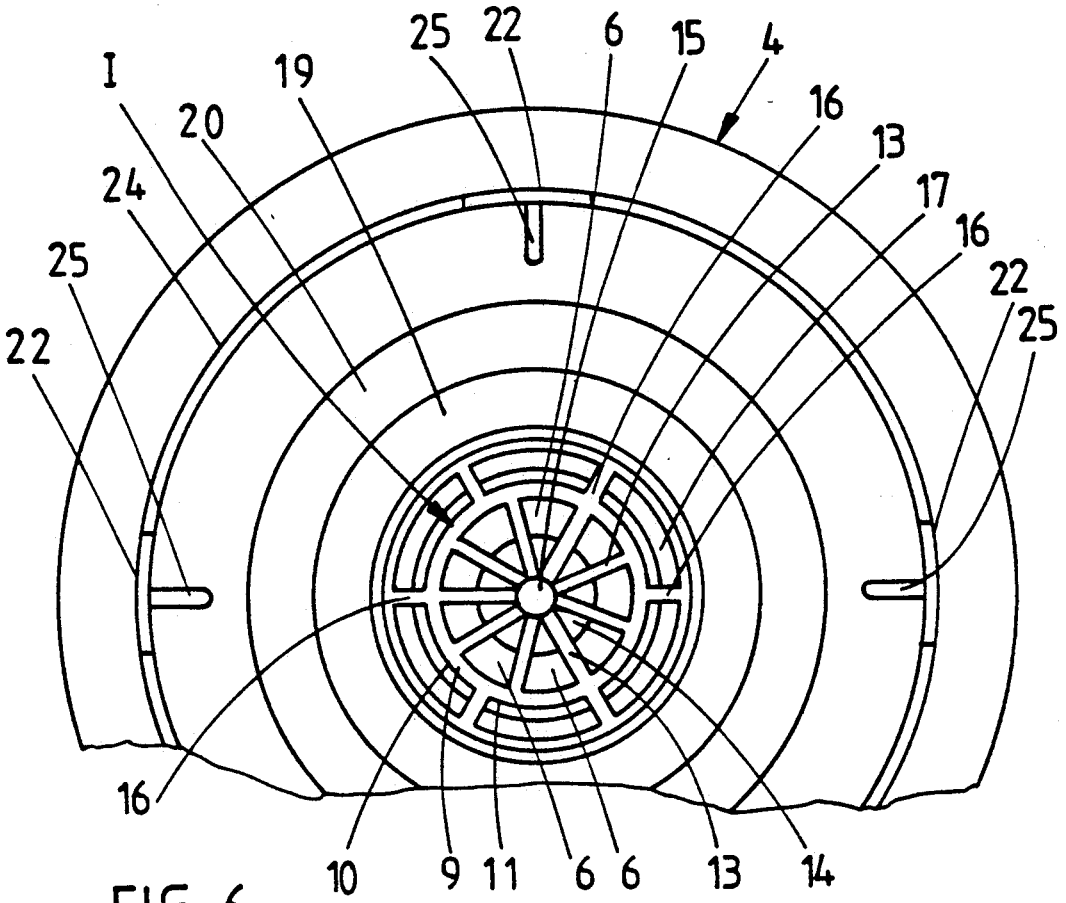
FIG. 6 is a view of the work disk by itself, in top view.

The floor-care apparatus G, developed as a polisher or so-called waxer, has three drive plates 1 which are driven jointly. These plates extend inward of the housing recessed behind a bottom plate 2 which has openings 3 which have a corresponding contour.

Each work disk 4 can be attached by clip connection to the respective individual work plates 1. The clip connection is a reversible one. Clip tongues 5 which extend downward from the drive plate 1 4 form a part thereof. The clip tongues 5 are distributed concentrically around the vertical axis of rotation x—x of the drive plate 1. A total of three clip tongues 5 arranged at equal angles apart is provided.

The clip tongues 5 engage into passage windows (openings) 6 in the floor-care work disk 4, said windows having a corresponding clip-tongue mating surface 7. This mating surface 7 comprises in each case a horizontally directed, annular shoulder in the passage window which is open towards the center of the work disk 4 which is provided on its bottom with a felt 8 or brush body.

All passage windows 6 are in a concave constriction I having the shape of a spherical segment. In it there engages a centrally located convex projection II, of corresponding contour, of the drive plate 1 in the manner of a ball and socket, but with slight axial play.

The constriction I thus forms for the drive plate 1 a resting support surface 9 which permits a limited wobbling movement between drive plate 1 and floor-care work disk 4.

As can be noted from the drawing, the resting surface 9 lies on the outside of the annularly arranged clip-tongue passage windows 6 and is formed primarily of a ring 10 located concentric to the axis of rotation x—x. Its top side bears in this connection in self-supporting manner a course of a spherical surface described. The ring 10 is part of an axially oriented annular wall 11. The head of the annular wall is wider, due to the development of the above-described clip-tongue mating surface 7, than the central region of the annular wall 11. Due to the peripherally rising concave course of curvature of the resting surface 9 or the ring 10, there is obtained a larger resting surface than the wall thickness measured horizontally in the region of the head.

The section of the projection II which cooperates directly with the resting surface 9, and therefore the region of the surface lying in front of the outward directed clip noses 5', is designated 12.

Figure 9:
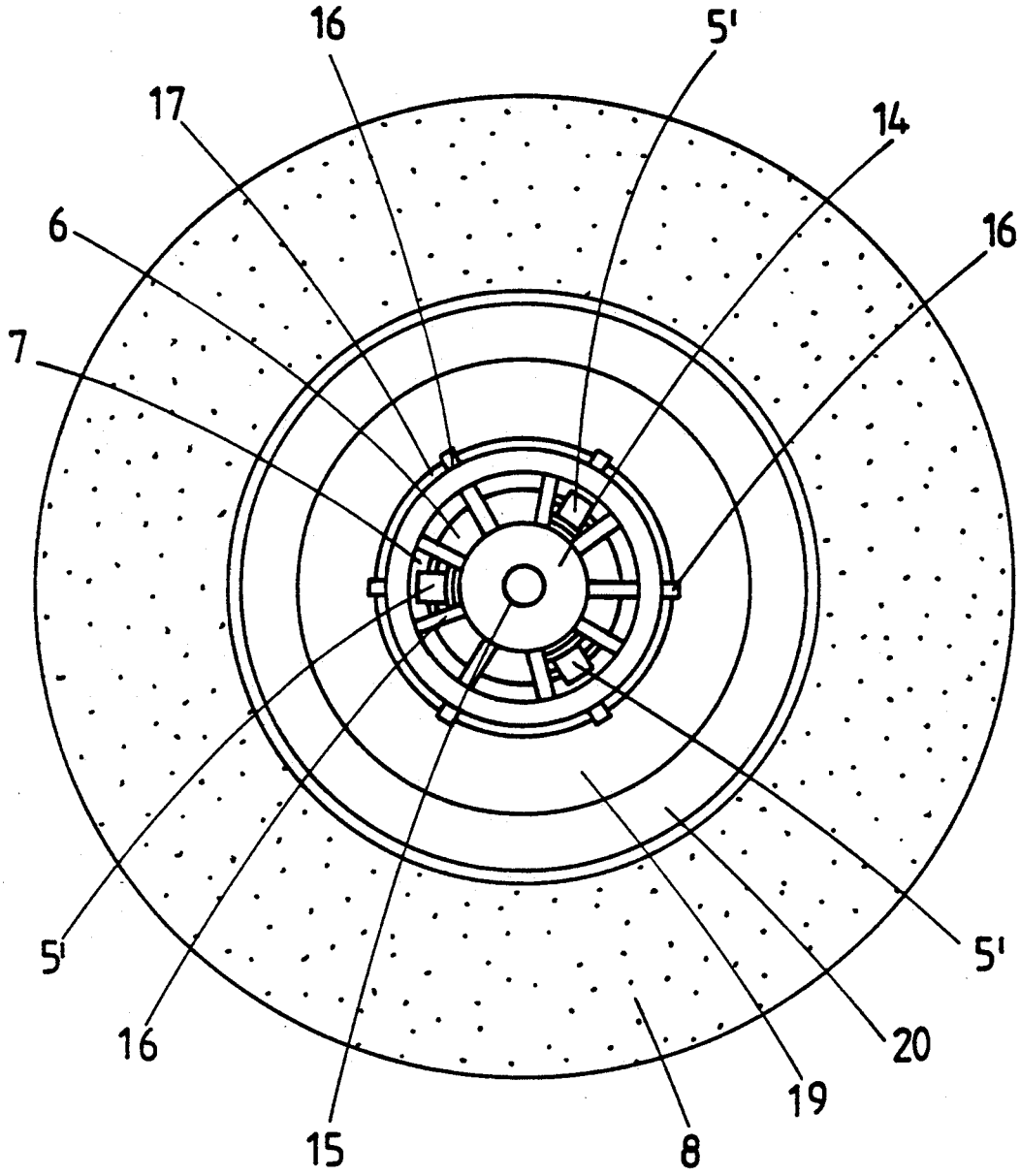
FIG. 9 is a bottom view of the work disk, clipped to the drive plate.

As can be noted particularly clearly from FIG. 9, the ring 10 surrounds the numerous uniform passage windows 6 provided. The passage windows 6 are divided off by radially directed spokes 13.

The latter are rooted in the manner of gusset plates in a centrally located horizontal annular plate 14. The latter practically closes off the bottom of the constriction I. The hole in the annular plate 14 bears the reference number 15. A total of nine spokes 13 arranged at equal angles apart are produced.

The ring 10 of the constriction I which forms the upper edge of a basket-like structure is then bound by radially directed arms 16 to the body of rotational symmetry of the work disk 4. As a whole, six arms 16 arranged at equal distance apart are developed. The annular plate 14 is recessed somewhat with respect to the top of the spokes 13', which are directed in the shape of a spherical segment. The arms 16 bridge over an opening 17 in the work disk 4, which opening is concentric to the ring 10, it being continued, in the region of the connection of said constriction I, in an upward directed collar 18. The latter is of annular shape and extends over the cover 19 of a development 20 in the shape of a conical frustum from the base of which a horizontally directed support and attachment section 24 for the care attachment extends. The felt ring 8 or the like is seated on the lower side thereof.

On the top of the felt-ring attachment zone, there are upwardly directed supporting fingers 22 as maximum tilting limitation stops for the wobbling movement. The supporting fingers 22 cooperate with a horizontal inner surface 1' of the drive plate 1 which is close to the edge. As a whole, four such supporting fingers 22 are developed, namely at equal distances apart in circumferential direction.

Furthermore, the support fingers 22 are connected with each other by a circumferential vertical annular wall 24 which stiffens the support and fastening section 21 and, furthermore, stiffened by radial struts 25 on the inner side.

Opposite the thickened head end which forms the supporting surface 9, the annular wall 11 is again thickened. This thickening bears the reference numeral 26. The thickening 26, together with the annular wall 11, represents an angle profile in which the corresponding downwardly widened arms 16 are rooted and thus stiffen the annular wall 11.

The bipartite nature of the drive plate 1 in the embodiment selected by way of example and the projection II bearing the clip tongues 5 are explained in detail below. There is a body having the shape of a spherical segment adjoining the spherically curved surface region 12 of which there is a cylindrical edge wall 27. The latter is seated snugly on the flat plate base of the drive plate 1. The capsule-like projection II is held in the bottom of the plate via detent projections 28. The corresponding detent mating surfaces bear the reference numeral 29. In addition, an adhesive attachment can be used. The downwardly curved projection II extends in dome-like manner over a centrally located hub 30 of the drive plate 1, which advantageously has a metal lining injected therein in the form of a sleeve 31.

A total of three detent projections 28 are formed, opposite which there are twice the number of detent surfaces 29 on the drive plate side. These are window-like cut-outs which, recessed somewhat, form said detent mating surfaces 29.

Concentrically to the annular wall 27 the dome-shaped or cap-shaped projection II has on the inside a concentric annular wall 32. The latter imparts a circumferential U-shaped profile, with U opening lying on the apparatus side, to the injection molding of rotational symmetry. The clip tongues 5 are cut out of said wall in the opposite direction, their clip projections 5' protruding clearly over the outer surface of the projection II.

Figure 7:
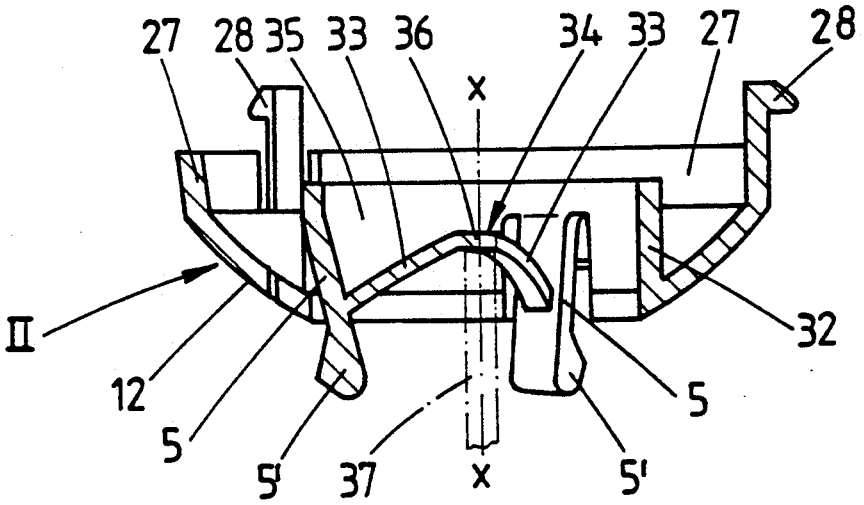
FIG. 7 shows by itself the clip-tongue arrangement with spider, shown in position of release, all developed on the cap-shaped body.
Figure 8:
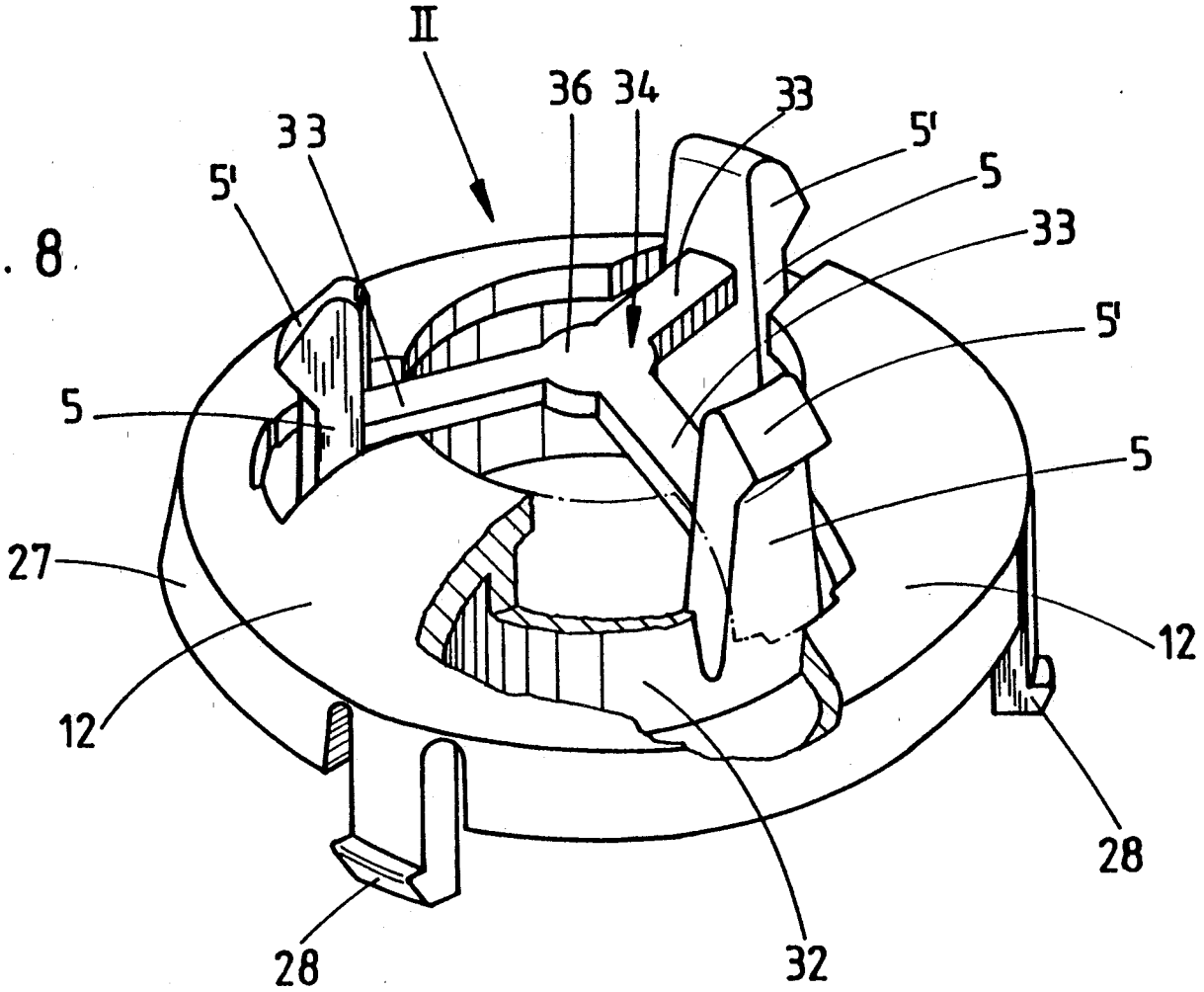
FIG. 8 shows the cap-shaped body in an individual perspective view, partially broken away.

The three clip tongues 5 are connected to each other at their back via radial arms or tines 33 of a spider 34. The spider 34 extends in a plane parallel to the plane of the drive plate 1. The spider 34 can be bent centrally. Reference is had to the showing in FIG. 7. The bend lies in the direction of the device G. In this direction a slight prebending can be used as basic position, so that, upon a radially-sprung deflection of the clip tongues 5, for instance in the case of insertion assembly, the center of the spider 34 moves away into the region in which a free space 35 which can be used for this purpose is present, and therefore into the inside of the dome-shaped projection II. The spider 34 thus forms a rear support supporting the standing stability of the clip tongues 5 and also, at the same time, a central control handle for the uncoupling of any clip mountings which are set too tightly, which tight setting lies definitely within the concept of the proper functional association of the work disk with the drive rotary plate 1.

For the corresponding accessibility of the central bendable spider 34, the floor-care work disk 14 is provided, centrally to the annular resting surface, 9, with the aforementioned hole 15 which is located directly below the center of the spider 14.

As aid in uncoupling, a tool can be used which is always right at hand, namely a screwdriver, nail or other elongated body of this type. In order to obtain a sufficiently large pressure application surface, the center of the spider 34 may, as can be noted from the drawing, be enlarged to form a gusset plate 36, possibly even with a depression lying on the hole side for the centering of the tool 37, used shown in dash-dot line in FIG. 11.

The stub shaft which supports the work disk 4 is not shown in the drawings. It engages into the sleeve 31.

For the peripheral drive attack, each drive plate 1 bears a rotating friction lining 38. The three work disks 1 shown in FIG. 2 assume a position in space with respect to each other which permits their central drive.

Figure 12:
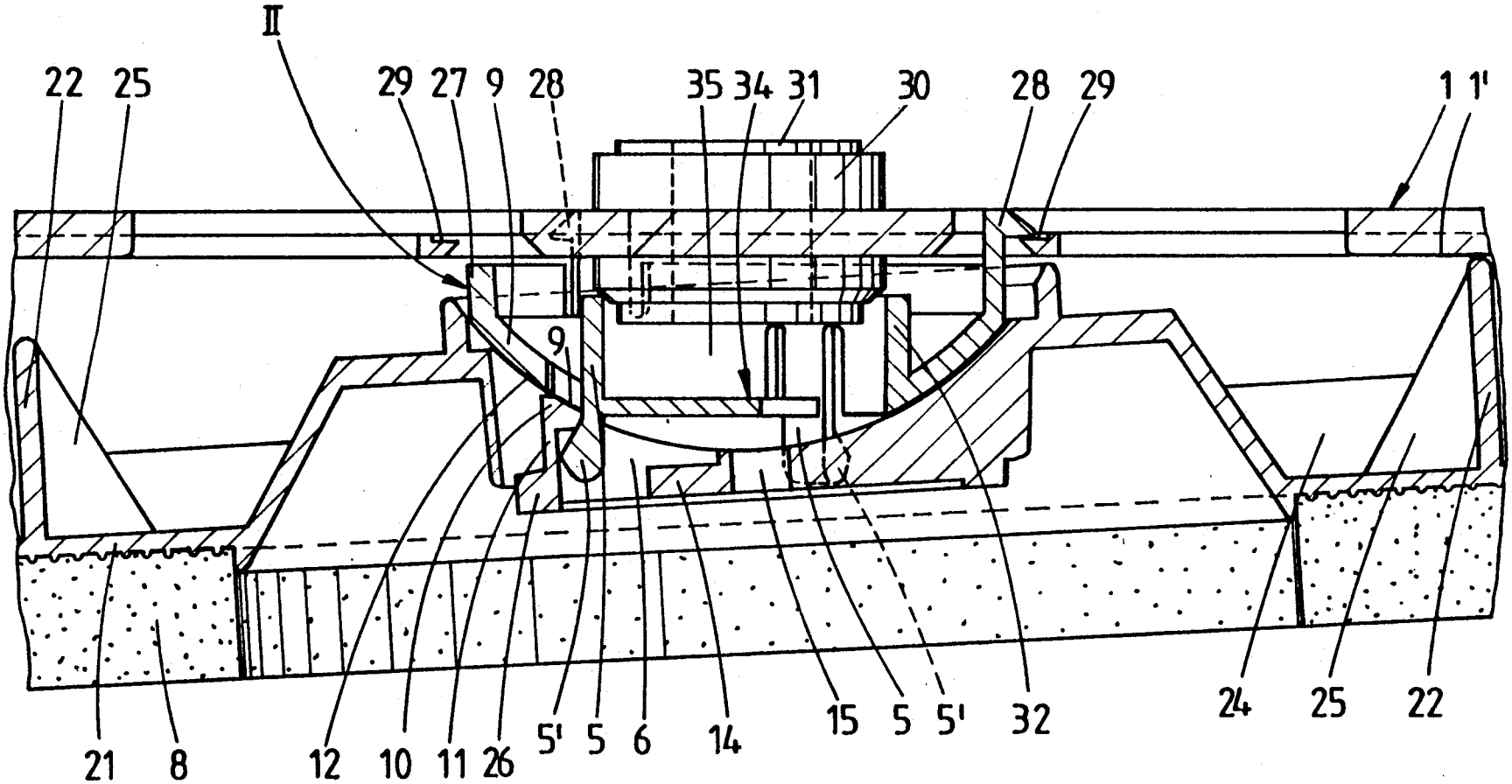
FIG. 12 is an identical showing, illustrating the wobbling movement.

For the replacement of the work disk 4, the latter need merely be withdrawn axially downward. If too much force is required for this, it is merely necessary to introduce the tool 37 described and press the spider core 34 accordingly inward. In this way, the three work disks 4 can be "threaded" one after the other even onto the tool 37. With respect to the wobbling movement, reference is made to FIG. 12. From it, it can also be seen that, despite this wobbling movement, the clip tongues 5 do not become disengaged. Intentional actuation and control of all three clip tongues 5 together is required.

The clip association, as well as the withdrawing of the work disk 4, is facilitated by oblique clip and run-on flanks of the clip tongue heads 5'.

We claim:

1. A floor-care work disk which is clippable to a drive plate of a floor-care apparatus, comprising a floor-care work disk formed with clip-tongue passage openings and a support surface adjacent thereto, said support surface is arranged on the work disk outside of the clip-tongue passage openings, said drive plate having means comprising a projection having clip tongues extending therefrom through said clip-tongue passage openings for clipping engagement with said work disk and providing a direct drive entrainment of the work disk by said drive plate, said projection having a curved surface displaceably engagable with and substantially complementary to said support surface, said clip tongues extending through said clip-tongue passage openings with sufficient clearance for permitting a wobbling abutment movement between the drive plate and the floor-care work disk.

2. A floor-care work disk, in particular according to claim 1, wherein the support surface annularly surrounds the clip-tongue passage openings.

3. A floor-care work disk according to claim 1, wherein the support surface is annular and forms a recess in a form of a spherical segment, and said curved surface of said projection is in a form of a spherical segment, said spherical segments displaceably engage each other providing said wobbling abutment movement.

4. A floor-care work disk according to claim 1, wherein said work disk in back of the support surface forms clip-tongue mating surfaces.

5. A floor-care work disk according to claim 1, wherein said work disk has a ring connected thereto disposed centrally in an opening in the work disk, and said passage openings are separated by radially directed spokes of said ring.

6. A floor-care work disk with said drive plate for the clip mounting of said floor-care work disk according to claim 1, further comprising a central bendable spider connects said clip tongues.

7. A floor-care work disk according to claim 6, wherein the floor-care work disk has a hole below a center of said spider and centrally to said support surface.

8. A floor-care work disk according to claim 6, wherein said clip tongue are releasably connected with said work disk and are releasable from said work disk and said passage openings by bending bendable tines of said spider, said tines connecting said clip tongues, whereby said work disk falls free.

9. A floor-care work disk according to claim 1, wherein said projection comprises a cap-shaped body shaped as a spherical segment and connected at an edge thereof to the drive plate, and said clip tongues extend from said body.

10. A floor-care work disk according to claim 1, wherein said passage openings are spaced annularly, concentrically around a central axis of rotation of said work disk, at equal angles apart and radially inward of said support surface, and form rotary drive places for said clip tongues.

11. A floor-care work disk according to claim 10, wherein there are three of said passage openings.

12. A floor-care work disk which is clippable to a drive plate of a floor-care apparatus, comprising a floor-care work disk formed with clip-tongue passage openings and a support surface adjacent thereto, said support surface is arranged on the work disk outside of the clip-tongue passage openings, said drive plate having means comprising a projection having clip tongues extending therefrom through said clip-tongue passage openings for clipping engagement with said work disk and providing a direct drive entrainment of the work disk by said drive plate, said projection having a surface forming a pivot bearing joint with said support surface, a least one of said surfaces being curved, said clip tongues extending through said clip-tongue passage openings with sufficient clearance so as to permit a wobbling abutment movement between the drive plate and the floor-care work disk.

* * * * *